US006305249B1

(12) United States Patent
Wang

(10) Patent No.: US 6,305,249 B1
(45) Date of Patent: Oct. 23, 2001

(54) ADJUSTABLE WRENCH

(76) Inventor: Kuang Pin Wang, No425, Ta-Tun 4th Street, Taichung (TW)

( * ) Notice: Subject to any disclaimer, the term of this patent is extended or adjusted under 35 U.S.C. 154(b) by 0 days.

(21) Appl. No.: 09/544,817

(22) Filed: Apr. 7, 2000

(51) Int. Cl.[7] ..... B25B 13/46

(52) U.S. Cl. ..... 81/63; 81/125.1; 81/145; 81/177.4

(58) Field of Search ..... 81/63, 125.1, 145, 81/146, 155, 166, 177.4

(56) References Cited

U.S. PATENT DOCUMENTS 4,084,456 * 4/1978 Pasbrig ..... 81/125.1 X 4,909,107 * 3/1990 Jeremic ..... 81/166

* cited by examiner

*Primary Examiner*—James G. Smith
(74) *Attorney, Agent, or Firm*—Rosenberg, Klein & Lee

(57) ABSTRACT

A adjustable wrench comprised of a body, a pressing piece, a sliding block and a micro-adjustment applicable to bolts of various sizes since the sliding block for adjusting the spacing between the micro-adjustment and a first and a second planes respectively can be automatically restored to its original location by means of the bouncing force provided by a first flexible element, and such spacing can be inched by rotating the micro-adjustment.

1 Claim, 6 Drawing Sheets

ADJUSTABLE WRENCH

BACKGROUND OF THE INVENTION

1. Field of the Invention

The present invention relates to an adjustable wrench, and more particularly, to one that allows easy and fast adjustment, and firm positioning.

2. Description of the Prior Art

In the prior art of the present invention as illustrated in FIG. 7, a wrench is provided with a handle 8 and a slide 9. A multiple of tooth 81 is provided on one side of the handle 8, a clamping member 82 to hold a bolt 7 is provided at the end of the handle 8, an axis 91 is provided at one side of the slide 9, said axis 91 is pivoted to a thumb 92 held against by a passive flexible tab 93, and one end of said thumb 92 is provided with a multiple of tooth 921 to ratchet the tooth 81 from the handle 8.

In use, a user has to press the thumb 92 to make the tooth 921 of the thumb 92 to disengage from the tooth 81 of the handle 8 before moving forward or backward the handle 8 to change the distance between the clamping piece 82 and the inner edge 94 of the slide 9. In the process of moving the handle 8, the tooth 921 from the thumb 92 must be completely cleared away from the tooth 81 of the handle 8. While pressing the thumb 92, the handle with inherited heavy weight must be pushed with a force that prevents an easy movement precisely by one tooth for the handle 8. The difficulty in inching just for a distance of one tooth results in the creation of a space between the clamping piece 82 and the bolt 7 to be turned, and furthermore in the failure of securing the bolt 7.

Whereas the thumb 92 is pivoted to the slide 9 by the axis 91, and is ratcheted to the tooth from the handle 8 due to the plunging from the flexible tab 93. In use, the thumb 92 must be pressed to completely disengage its tooth 921 from the tooth 81 of the handle 8 before pushing the handle 8 to adjust the distance between the clamping piece 82 and the inner edge of the slide 9. In case of any failure to press the thumb 92 all the way to the end to move the handle 8, the thumb 92 can get easily worn out since certain piece of the tooth 921 close to the axis 91 has not yet disengaged from the tooth 81 of the handle 8. When said piece of the tooth 921 is worn out, with only the remaining tooth 921 ratcheted to the tooth 81 of the handle 8 resulting in sliding, thus to serious affect the positioning effect of the thumb 92.

Furthermore, the distance between the clamping piece 82 and the inner edge 94 of the slide 9 is adjusted by pushing the handle 8. Since the bolt 7 is available indifferent sizes, and the adjustment can only be achieved by the multiplex of pitch of the tooth 81, the adjustment fails to be made exactly depending on the individual size of the bolt 7. If the pitch of the tooth 81 is made wider, the greater ratcheting force is provided, but the range for adjustment gets narrower. On the contrary, if the pitch of the tooth 81 is made narrower, the ratcheting force gets too small to cause sliding.

SUMMARY OF THE INVENTION

The primary purpose of the present invention is to provide a wrench to facilitate easy adjustment by a very smooth slide that is used to adjust the spacing between the micro-adjustment and the first and the second planes respectively, as well as by an automatic restoration due to the bouncing force from a first flexible element.

Another purpose of the present invention is to provide a wrench that is capable of avoiding local tear and wear of the ratcheting block, and allowing sufficient contact and ratcheting force to be applied between the ratcheting block and the slide since the tooth from the slide can be ratcheted to or separated from the tooth of the ratcheting block at the same time.

Another purpose yet of the present invention is to provide a wrench that is capable of inching the spacing between the micro-adjustment and the first and the second planes respectively by rotating the micro-adjustment.

DETAILED DESCRIPTION OF THE PREFERRED EMBODIMENTS

Figure 1:
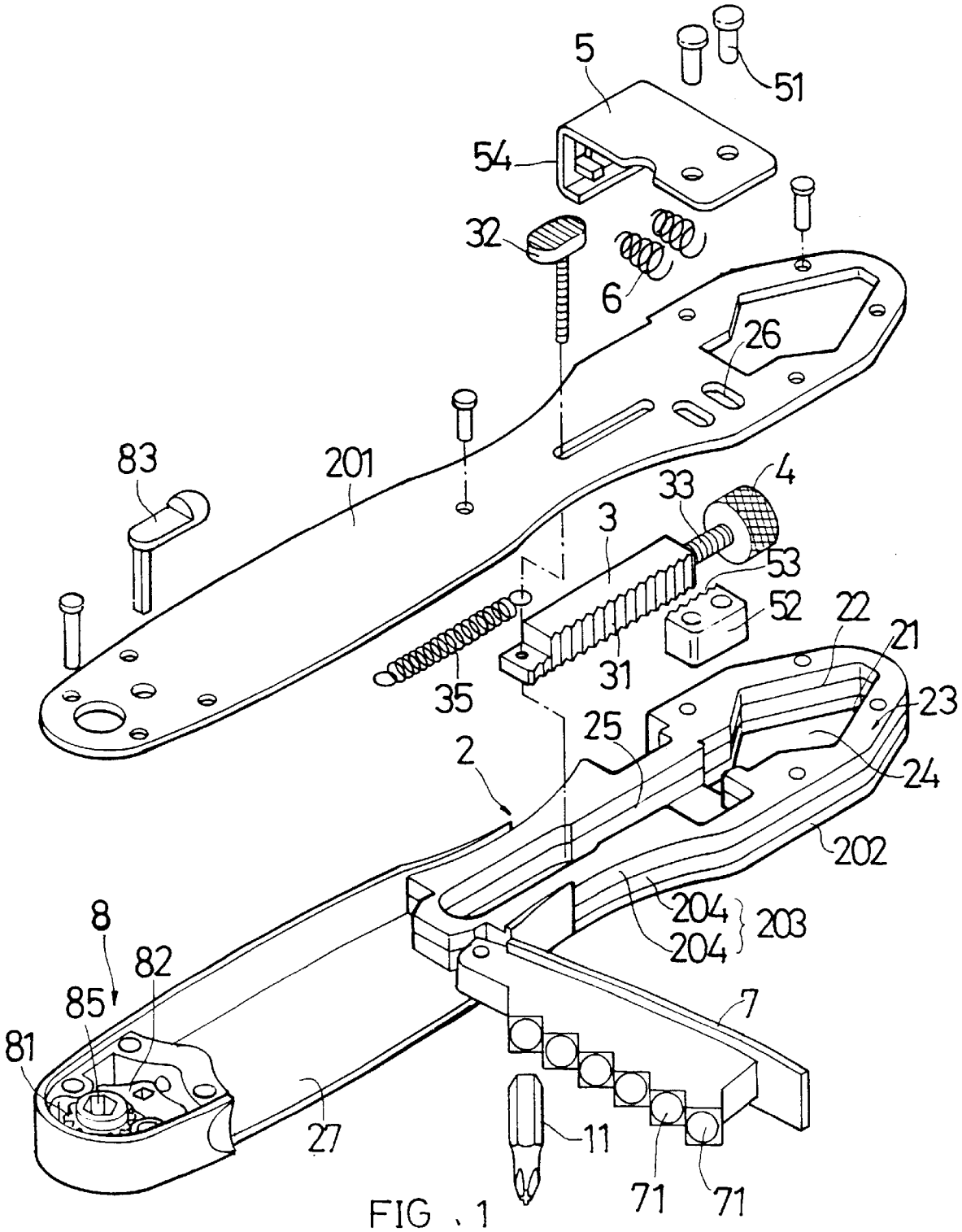
FIG. 1 is a blowout view of the present invention.

Referring to FIGS. 1 through 6, the present invention is related to a wrench essentially comprised of a body 2, including a filler 203 formed by the lay up of a plurality of flat plates 204 sandwiched between a top plate 201 and a base plate 202. A space to accommodate members is provided within the filler 203. A clamping portion 23 provided at the front end of the body 2 contains at lest a first and a second plane 21, 22 and an angle between the two planes 21, 22 forms a clamping space 24. In the first preferred embodiment of the present invention, the angle between the planes is 60 degrees. A rectangular sliding trough 25 is separately provided to the body 2 and a hooker 251 is provided at the bottom of said sliding trough 25. One side to the sliding trough 25 is provided with two slots 26, and a hollow compartment 27 is provided in the middle section of the body 2.

A sliding block 3 is provided in the sliding trough 25 to the body 2, and a plurality of teeth 31 are provided on one side of the sliding block 3. A stationary push button 32 fixed to the sliding block 3 protrudes from the body 2, while a worm gear 33 is provided at the front end of the sliding block 3. A larger radius section 41 is provided on the far end, away from the worm gear, of a micro-adjustment 4 locked onto the worm gear 33. A protruding portion 331 is provided at the terminal end of the worm gear 33 to stop at the end surface of the larger radius section 41, to prevent the micro-adjustment 4 which is located inside the clamping space 24 from escaping. Furthermore, a hooker 34 is provided at the rear end of the sliding block 3, and a return spring, as the first flexible element 35, is provided between the hookers 251, 34 respectively from the body 2 and the sliding block 3.

A pressing piece 5 extending sideways from the top of the body 2 penetrates through the slots 26 of the body 2 with two fixation pieces 51 and a ratcheting block 52 is fixed to the pressing piece 5. A plurality of teeth 53 are provided on a surface of the ratcheting block 52 at a location that corresponds to the sliding block 3 while the teeth 53 can be ratcheted to or separated from the teeth 31 of the sliding block 3 at the same time. A push piece 54 is formed by the pressing piece on the other side of the sliding block 3 and a plurality of second flexible elements 6, i.e. compression springs, are provided between the push piece 54 and the body 2 to keep the teeth 51 from the pressing piece 5 constantly being ratcheted to the teeth of the sliding block 3.

A side lid 7 is pivoted to one side of the hollow space 27 in the body 2, and a plurality of grooves 71 are provided on the side lid 7 to receive insertion of a tooling head 11.

A ratchet and pawl 8 provided in the rear of the body 2 includes a pivoting ratchet 81 sandwiched between the top plate 210 and the base plate 202, a pawl 82 is engaged with the ratchet 81 to restrict it to engage in only unidirectional rotation. A thumb member 83 is provided to switch the direction of the pawl 82, and a spring 84 is provided to bias the pawl 82. A socket connector 85 is provided at the center of the ratchet 81 so that the present invention can become a socket wrench.

Figure 2:
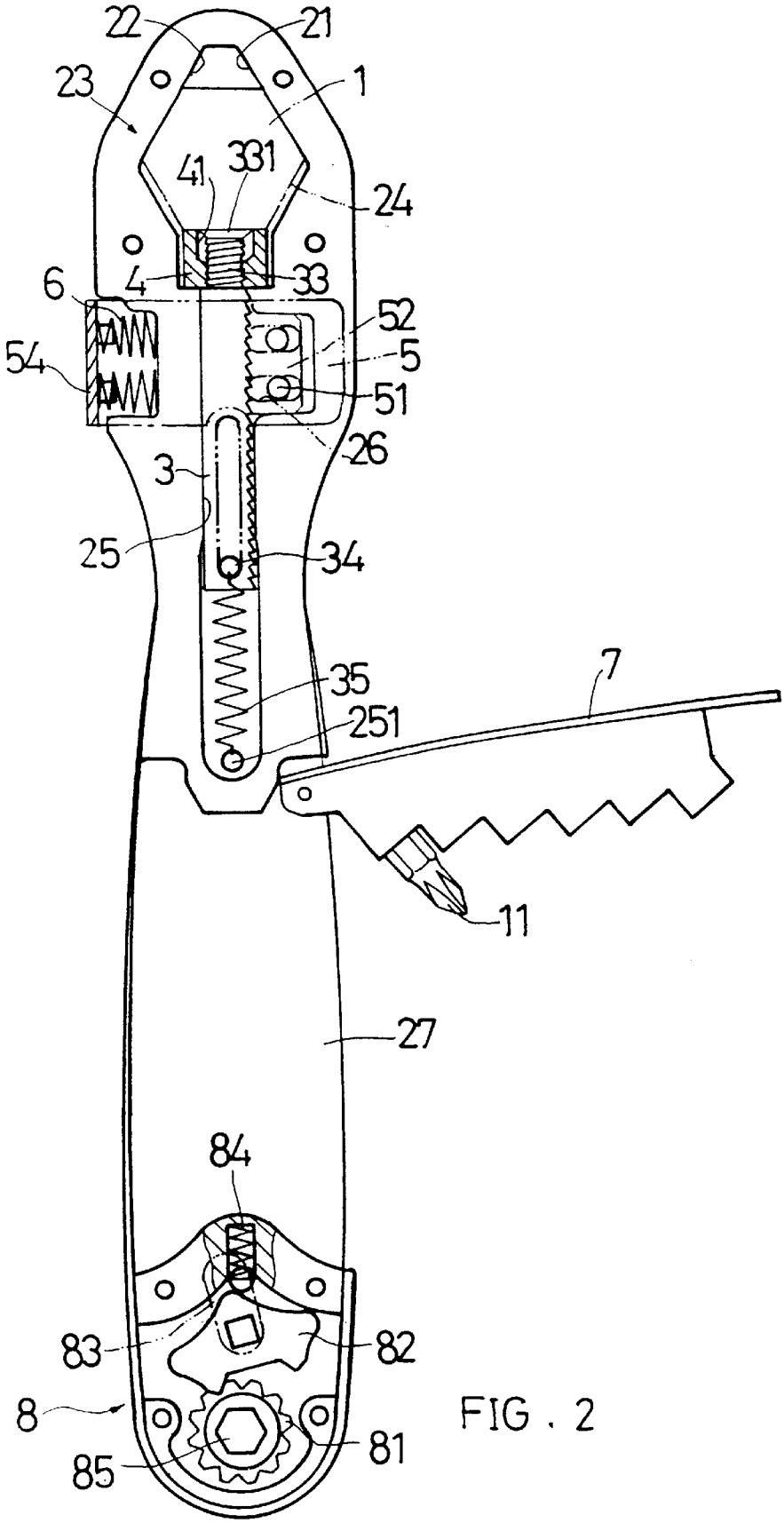
FIG. 2 is a schematic view showing that the present invention is applied to a larger bolt.
Figure 3:
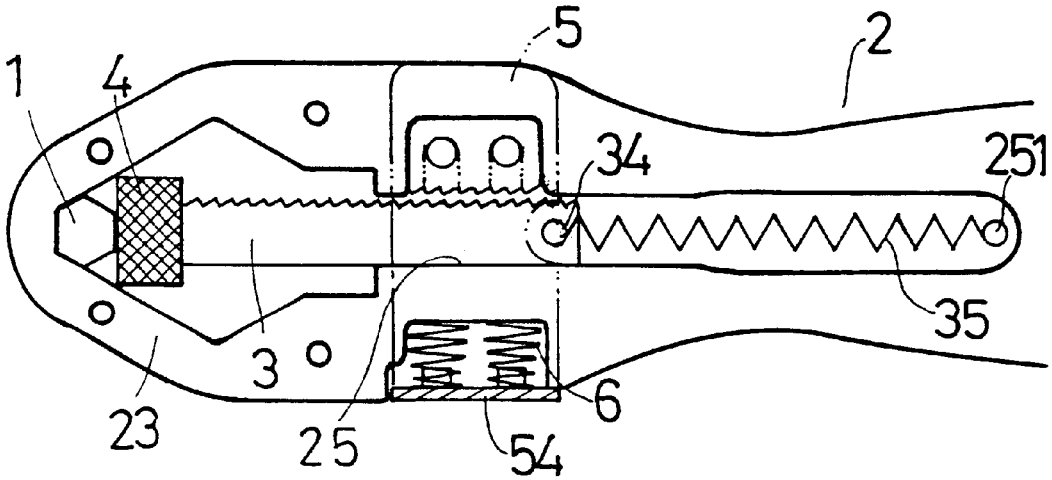
FIG. 3 is schematic view showing that the present invention is applied to a smaller bolt.

In use, a bolting piece 1, that can be a bolt or nut, is received within the clamping space 24. As illustrated in FIGS. 2 and 3, both of the first and the second planes 21, 22 are in contact with corresponding sides of the bolting piece 1, so that a user is able to adjust the spacing between the micro-adjustment 4 at the front end of the sliding block 3 and the bolting piece 1, to have the top of the micro-adjustment 4 holding against the bolting piece 1 simply by pushing the sliding block 3 with the push button 32. Whereas the sliding block 3 allows light and quick motion, a fast and convenient adjustment can be achieved. Once the micro-adjustment 4 is held against the bolting piece 1, the body 2 is turned to either tighten or loosen the bolting piece 1. To withdraw the wrench, the push piece 54 of the pressing piece 5 is pressed to disengage the teeth 53 of the ratcheting block 52 from the teeth 31 of the sliding block 3. Then, the first flexible element 35 will retract, due to its inherent flexibility, to pull back the sliding block 3 for them micro-adjustment 4 to automatically return to its previous location. Since the micro-adjustment 4 is no longer holding against said bolting piece 1, the wrench can be removed without the user's finger being used to push both the sliding block 3 and the micro-adjustment 4 back to their previous locations.

Figure 4:
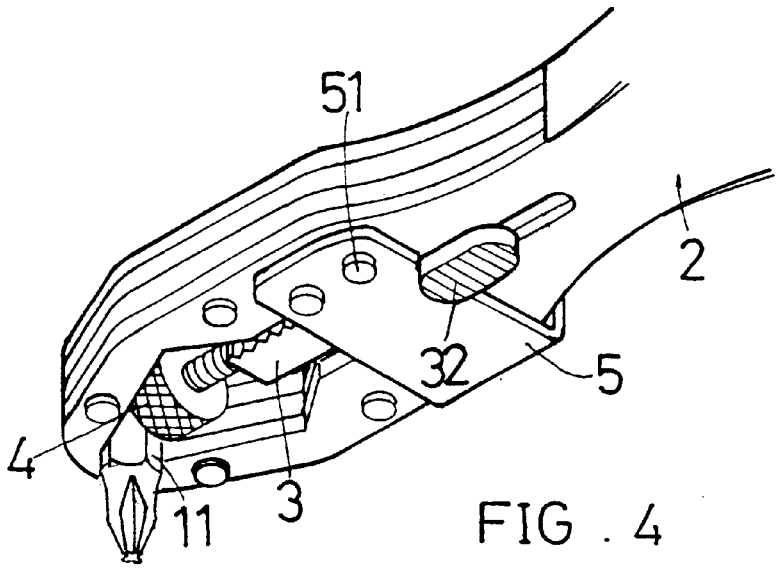
FIG. 4 is a schematic view showing that the present invention is used as a driver in conjunction with a tooling head.

As illustrated in FIG. 4, said clamping space 24 can receive the toling head 11 therein, the tooling head 11 being removed from compartment 27 of the body 2 for the wrench to function as a screwdriver.

Figure 5:
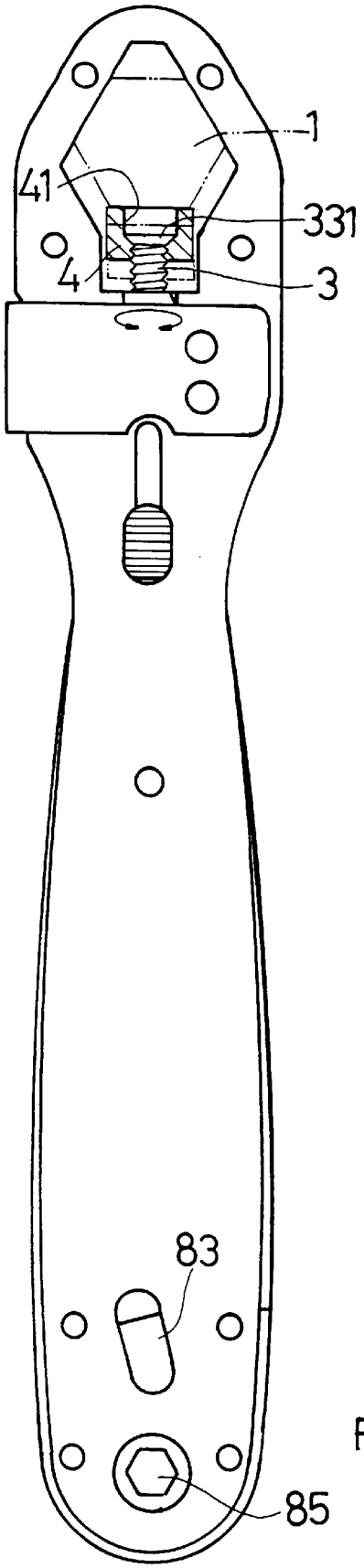
FIG. 5 is a schematic view showing the operation of the micro-adjustment of the present invention.

To adjust the spacing between the micro-adjustment 4 and the first and the second planes 21, 22 respectively, turn the micro-adjustment 4 to inch the spacing respectively between it and the first and the second planes 21, 22 in conjunction with the worm gear 33 from the sliding block 3, as illustrated in FIG. 5. The adjustment can be easily made depending on the individual size of the bolt by directly turning the micro-adjustment 4 with one's thumb.

Figure 6:
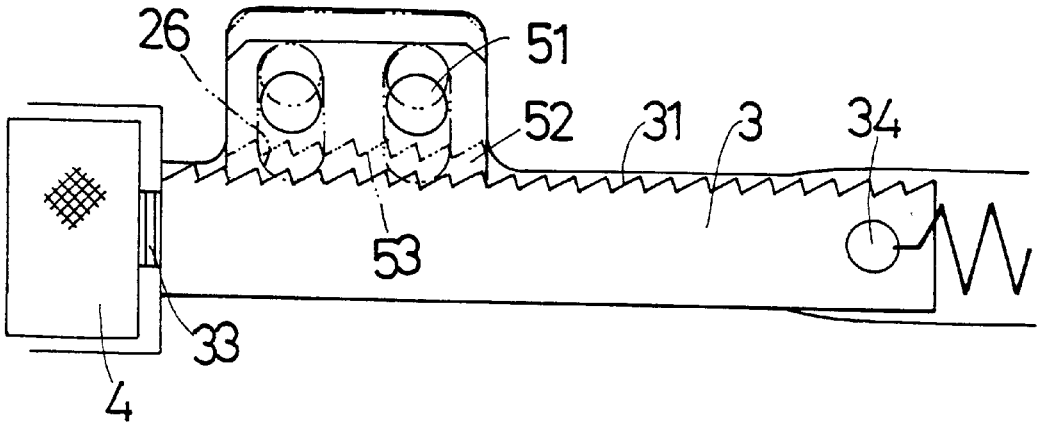
FIG. 6 is a schematic view showing that the tooth of the ratcheting block is engaged to and disengaged from the tooth of the slide at the same time.
Figure 7:
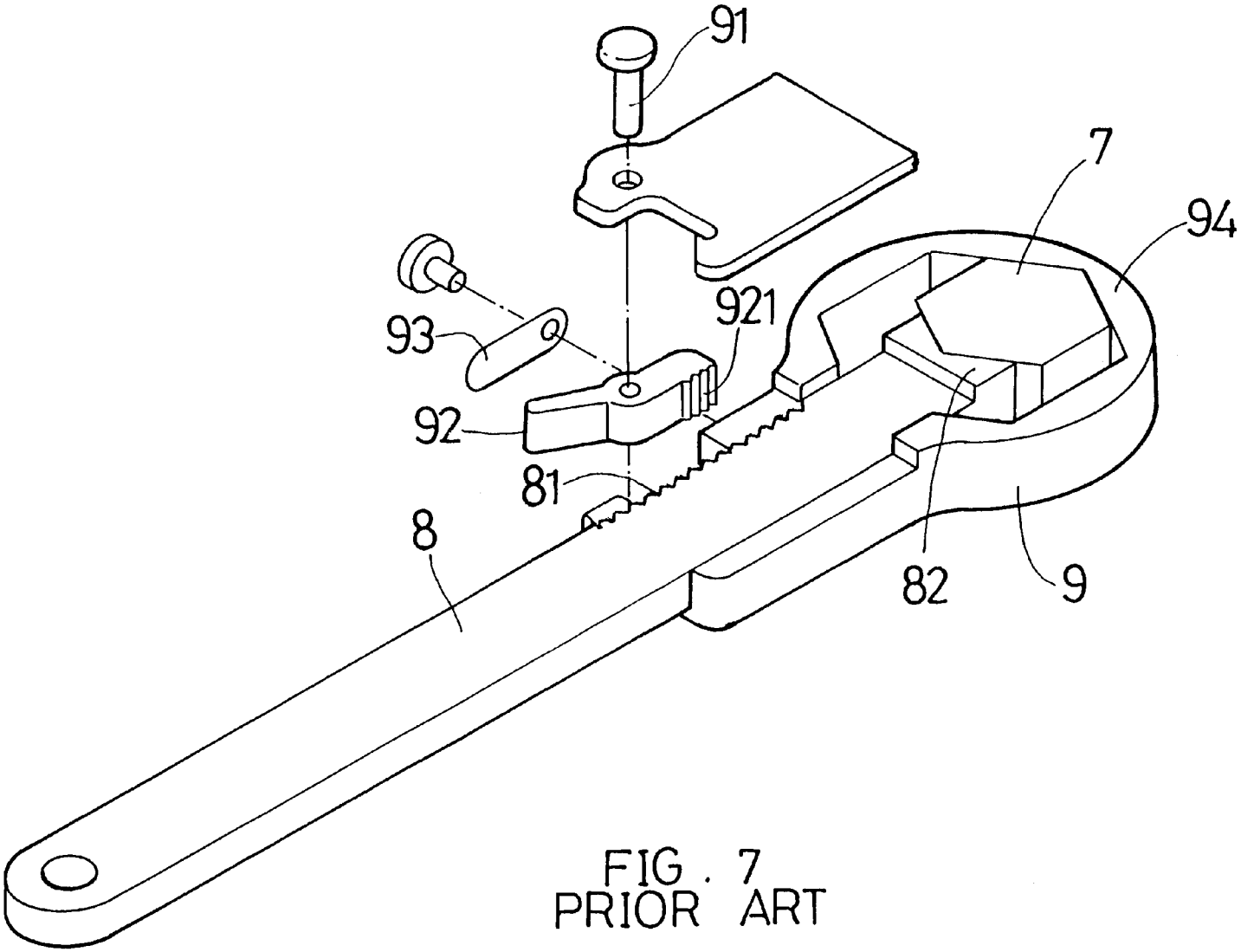
FIG. 7 PRIOR ART
FIG. 7 is a blowout view of the prior art of the present invention.

Now referring to FIG. 6, the teeth 31 of the sliding block 3 of the present invention can be ratcheted to or separately from the teeth 53 of the ratcheting block 52 at the same time. If the pressing piece 5 is not fully pushed to its bottom, contact remains between the teeth 31 and the teeth 53 to prevent pushing said sliding block 3. Thus, to prevent local wear and tear for the teeth 53 from the ratcheting block 52, and to provide sufficient contact and ratcheting force between the ratcheting block 52 and the sliding block 3. Therefore, the wrench is firmly secured in position to avoid displacement. Slots 26 in the body 2 guide the operation of the pressing piece 5 to further guarantee the firm positioning of the wrench.

To sum up, the present invention permits a fast and convenient adjustment due to a very light and smooth operation of the sliding block 3 in adjusting the spacing between the micro-adjustment 4 and the first and the second planes 21, 22, and the automatic restoration by the first flexible element 35. Furthermore, the teeth 31 of the sliding block 3 are capable of ratcheting or separating from the teeth 53 of the ratcheting block 52 at the same time, thus, local wear and tear to the teeth 53 of the ratcheting block 52 can be avoided. Meanwhile, sufficient contact and ratcheting force are provided between the ratcheting block 52 and the sliding block 3 to firmly hold the wrench in position, and the spacing between the micro-adjustment 4 and the first and the second planes 21, 22, can be inched by rotating the micro-adjustment 4 depending on the individual size of the bolt.

I claim:

1. An adjustable wrench comprising:

a longitudinally extended body formed by a filler sandwiched between a top plate and a bottom plate, said body having a clamping portion formed on a first end thereof, said clamping portion including a clamping space bounded on one end thereof by a pair of angled planar surfaces, said body having a longitudinally extended sliding trough formed therein, one end of said sliding trough being in open communication with said clamping space and at a location opposite said angled planar surfaces, said body having a hollow compartment disposed between said top and bottom plates;

a sliding block disposed in said sliding trough, said sliding block having a plurality of teeth formed on one side thereof;

a ratcheting block disposed adjacent said sliding block, said ratcheting block having a plurality of teeth formed in one side thereof corresponding to said teeth of said sliding block;

a pressing piece affixed to said ratcheting block and slidably coupled to said body, said pressing piece being elastically biased to engage said teeth of said ratcheting block with said teeth of said sliding block, said pressing piece being displaceable to disengage said teeth of said ratcheting block from said tooth of said sliding block;

a push button coupled to said sliding block for slidably displacing said sliding block toward said angled planar surfaces responsive to displacement of said push button;

a micro-adjustment coupled to a first end of said sliding block by a worm gear for providing fine adjustment of a gap between an end portion of said micro-adjustment and said angled planar surfaces;

an elastic member coupled between said body and a second end of said sliding block for retracting said sliding block responsive to said disengagement of said teeth of said ratcheting block from said teeth of said sliding block;

a ratchet assembly provided at a second end of said body, said ratchet assembly including a pivoting ratchet having a centrally disposed socket connector and a pawl engaged with said pivoting ratchet, said pawl being selectively displaceable to control a rotative direction of said pivoting ratchet; and, a side lid pivotally coupled to said body to form a closure for said hollow compartment, said side lid having a plurality of grooves provided to respectively receive and store tooling heads therein.

* * * * *